US005518815A

United States Patent [19]

Koizumi

[11] Patent Number: 5,518,815

[45] Date of Patent: May 21, 1996

[54] THREAD RUBBER FOR THREAD WOUND GOLF BALL

[75] Inventor: Yoshimasa Koizumi, Kobe, Japan

[73] Assignee: Sumitomo Rubber Industries, Ltd., Hyogo, Japan

[21] Appl. No.: 326,513

[22] Filed: Oct. 21, 1994

[30] Foreign Application Priority Data

Oct. 21, 1993 [JP] Japan ..... 5-287395

[51] Int. Cl.[6] ..... D02C 3/00

[52] U.S. Cl. ..... 428/372; 428/355; 428/250; 428/323; 473/356

[58] Field of Search ..... 273/62, 218, 222, 273/230; 324/904, 908, 493; 428/250, 323, 36.4, 375, 372; 252/362

[56] References Cited

U.S. PATENT DOCUMENTS

| | | | |
|---|---|---|---|
| 3,687,719 | 8/1972 | Klotzer | 524/493 |
| 3,990,990 | 11/1976 | Kojima et al. | 282/382 |
| 4,567,093 | 1/1986 | Sogabe et al. | 428/250 |
| 4,611,810 | 9/1986 | Kamata et al. | 273/218 |
| 5,395,666 | 3/1995 | Brindle | 428/36.4 |
| 5,405,666 | 4/1995 | Brindle | 428/36.4 |

*Primary Examiner*—N. Edwards

*Attorney, Agent, or Firm*—Birch, Stewart, Kolasch & Birch

[57] ABSTRACT

An inorganic powder mixture which is adhered to the surface of a thread rubber which is used for forming a thread rubber layer of a thread wound golf ball, said mixture including an inorganic powder having excellent lubricity and an inorganic powder having a small intermolecular cohesive force and excellent adhesion.

15 Claims, No Drawings

THREAD RUBBER FOR THREAD WOUND GOLF BALL

FIELD OF THE INVENTION

The present invention relates to a thread rubber for a thread wound golf ball. More particularly, the present invention relates to a thread rubber for a thread wound golf ball which restricts the flying of inorganic powder from the surface of the thread rubber during working (e.g. preparation of a thread wound core, etc.) and has good handling workability, thereby producing a thread wound golf ball having excellent physical properties such as resilience, durability and the like.

BACKGROUND OF THE INVENTION

A thread wound golf ball is a golf ball composed of a center (liquid center or solid center), a thread rubber layer formed by winding a thread rubber in a stretched state around the center, and a cover which covers the thread rubber layer.

It is necessary for a golf ball to have a suitable resilience performance in order that the golf ball may have excellent flying performances. In the case of the thread wound golf ball, the thread rubber layer has a great effect on resilience performances and, therefore, the characteristics of the thread rubber are considered to be particularly important.

The thread rubber is normally prepared by molding a mixture containing a natural rubber or an isoprene rubber or a rubber blend thereof as a base rubber, vulcanizing agents, vulcanizing accelerators, vulcanizing accelerator auxiliaries, antioxidants and, if necessary, fillers, softening agents, etc. into a thin sheet-like product and cutting the resulting sheet-like product after vulcanization, or solidifying a latex to give a sheet and cutting the sheet after vulcanization.

Furthermore, inorganic powders having excellent lubricity (e.g. talc, etc.) are adhered to the surface of the rubber sheet before vulcanization in order to prevent adhesion between sheets when sheets are peeled off after vulcanization, or to obtain a thread wound golf ball having the large resilience coefficient by controlling a friction force between the thread rubber and the tension controlling pulley so as to stretch the thread rubber in a predetermined amount when the thread wound core is prepared by winding the thread rubber around the center.

However, there is the problem that talc adhered to the surface of the thread rubber flies about, from the surface of the thread rubber into the environment, when the thread wound core is prepared by winding the thread rubber with stretching around its center, thereby making the working atmosphere worse.

However, when the flying of talc during working is prevented by decreasing the amount of talc to be adhered on the surface of the thread rubber, the peeling between sheets becomes difficult or the thread rubber adheres to the tension control pulley when the thread wound core is prepared by winding the thread rubber around the center, which results in cutting of the thread rubber.

SUMMARY OF THE INVENTION

The main object of the present invention is to provide a thread rubber which prevents the inorganic powder adhered to the surface of the thread rubber from flying off during working and adversely affecting the atmosphere by improving the inorganic powder to be adhered to the surface of the thread rubber. The improved inorganic powder prevents adhesion between sheets and prevents the thread rubber from being damaged when the thread wound core is prepared by winding the thread rubber, with stretching, around the center. A thread wound golf ball is thus produced having excellent physical properties such as resilience performances, durability and the like.

This object as well as other objects and advantages of the present invention will become apparent to those skilled in the art from the following description.

The present invention has accomplished the above objects by adhering a mixture of an inorganic powder having excellent lubricity (e.g. talc, etc. ) and an inorganic powder having a small intermolecular cohesive force and excellent adhesion (e.g. magnesium carbonate, etc.) on the surface of the thread rubber.

That is, the present invention provides a thread rubber for a thread wound golf ball wherein a mixture of an inorganic powder having excellent lubricity and an inorganic powder having a small intermolecular cohesive force and excellent adhesion is adhered to the surface of the thread.

DETAILED DESCRIPTION OF THE INVENTION

Examples of an the inorganic powder having excellent lubricity include talc (hydrated magnesium silicate) described above, mica powder and the like.

Examples of an inorganic powder having a small intermolecular cohesive force and excellent adhesion include magnesium carbonate described above, (particularly, light magnesium carbonate) calcium carbonate and the like.

The reason why the flying of the inorganic powder from the surface of the thread rubber into the environment during working is decreased and the handling workability is improved (e.g. the thread rubber is prevented from being damaged when the thread wound golf ball is prepared by winding the thread rubber with stretching around the center, etc.) by adhering a mixture of the inorganic powder having excellent lubricity (e.g. talc, etc.) and the inorganic powder having a small intermolecular cohesive force and excellent adhesion (e.g. magnesium carbonate, etc.) on the surface of the thread rubber will be explained below with reference to the example wherein talc and magnesium carbonate are used as the inorganic powder having excellent lubricity and the inorganic powder having a small intermolecular cohesive force and excellent adhesion, respectively.

Talc has a scaly particle shape and is superior in lubricity, but its intermolecular cohesive force is large, and so it agglomerates easily. Therefore, talc is not uniformly adhered to the surface of the thread rubber but forms a part where the talc agglomerates and adhere as a mass. As a result, the part where the talc agglomerates to adhere as a mass, falls and flies around to make an undesirable working atmosphere.

To the contrary, magnesium carbonate is inferior to talc in lubricity but its intermolecular cohesive force is small, and so it does not agglomerate and is uniformly adhered on the surface of the thread rubber. Accordingly, when magnesium carbonate is formulated with talc, nonuniform adhesion as a disadvantage of talc is solved and the flying of the inorganic powder from the surface of the thread rubber during working is decreased, thereby preventing a deterioration in the working atmosphere caused by flying inorganic powder.

Accordingly, since the inorganic powder can be uniformly adhered to the surface of the thread rubber in a requisite amount for working, peeling between sheets is conducted smoothly. Furthermore, the thread rubber can be suitably stretched without causing damage of the thread rubber at the time of winding of the thread rubber.

Furthermore, nonuniform adhesion of talc becomes the cause for poor adhesion between the cover and the thread rubber layer when the cover is coated on the surface of the thread rubber layer. However, since the nonuniform adhesion of talc is solved by the utilization of magnesium carbonate, the adhesion between the thread rubber later and the cover is improved.

In the present invention, a mixing weight ratio of the inorganic powder having excellent lubricity (e.g. talc, etc.) to the inorganic powder having a small intermolecular cohesive force and excellent adhesion (e.g. magnesium carbonate, etc.) is preferably 85/15 to 30/70, particularly 80/20 to 35/65.

When the amount of the inorganic powder having excellent lubricity (e.g. talc, etc.) is larger than the above range of the mixing ratio, the effect of preventing deterioration of the working atmosphere due to flying of the inorganic powder from the surface of the thread rubber is seriously hampered. Further, when the amount of the inorganic powder having excellent lubricity (e.g. talc, etc.) is smaller than the above mixing ratio range, peeling between sheets becomes inferior and sticking between cross sections of the cut thread rubber is likely to occur.

Further, when the amount of the inorganic powder having a small intermolecular cohesive force and excellent adhesion (e.g. magnesium carbonate, etc.) is smaller than the above range of the mixing ratio, the effect of preventing deterioration of the working atmosphere due to the flying inorganic powder from the surface of the thread rubber can not be obtained. Further, when the amount of the inorganic powder having a small intermolecular cohesive force and excellent adhesion (e.g. magnesium carbonate, etc.) is larger than the above mixing ratio range, peeling between sheets becomes inferior and sticking between cross sections of the cut thread rubber is likely to occur.

The amount of the mixture of inorganic powders to be adhered on the thread rubber is not necessarily limited, but is preferably 5 to 15 parts by weight, particularly 6 to 10 parts by weight, based on 100 parts by weight of the thread rubber.

Further, the thread rubber itself is not specifically limited, and there can be used any of the conventional rubber threads. When the thread wound golf ball of the present invention is produced using thread rubber, the liquid center and cover are not specifically limited, and therefore, any of the conventional centers and covers can be utilized.

As described above, according to the present invention, there is provided a thread rubber which decreases amount of inorganic powder which flies from the surface of the thread rubber during working and thus prevents the deterioration of the working atmosphere, by utilizing a mixture of an inorganic powder having excellent lubricity (e.g. talc, etc.) and an inorganic powder having a small intermolecular cohesive force and excellent adhesion (e.g. magnesium carbonate, etc. ) as the inorganic powder to be adhered to the surface of the thread rubber, which improves the handling workability (e.g. prevention of adhesion between sheets, prevention of damage of the thread rubber at the time of preparation of the thread wound core, etc.), thereby affording a thread wound golf ball having excellent physical properties such as resilience performance, durability and the like.

EXAMPLES

The following Examples and Comparative Examples further illustrate the present invention in detail but are not to be construed to limit the scope thereof.

Examples 1 to 3

A thread rubber wherein a mixture of talc and magnesium carbonate shown in Table 1 was adhered on the surface was wound on a liquid center having a diameter of 28 mm to prepare a thread wound core having a diameter of 39 mm. The resulting thread wound core was covered with a semi-spherical shell-like balata half shell and subjected to a press vulcanization at 150° C., and then a paint was applied on the surface to prepare a thread wound golf ball having an outer diameter of 42.7 mm.

The amount of talc and magnesium carbonate in Table 1 is "part by weight", and a thread rubber used is that which contains a blend of a natural rubber and an isoprene rubber (weight ratio=30:70) as the base rubber and has a thickness of 0.5 mm and a width of 1.5 mm. Further, the amount of the inorganic powder to be adhered on the surface of the thread rubber is 7 parts by weight based on 100 parts by weight of the thread rubber.

Regarding the above thread rubber, the flying properties of the inorganic powder from the surface of the thread rubber during working and the handling workability of the thread rubber were examined. The results are shown in Table 1.

Further, the ball compression, the resilience coefficient, the hammering durability and the cut resistance of the resulting golf ball were examined. The results are also shown in Table 1.

The measuring method of the flying properties of the inorganic powder from the surface of the thread rubber during working and the handling workability of the thread rubber, and the measuring method of the ball compression, the resilience coefficient, the hammering durability and the cut resistance of the resulting thread wound golf ball are as follows.

Flying properties of inorganic powder:

The flying state of the inorganic powder from the surface of the thread rubber is observed when a thread wound core is prepared by winding the thread rubber around a liquid center while the thread rubber is stretching, and the evaluation is conducted according to the following criteria.

Evaluation criteria:

⊙: Flying of the powder is scarcely observed.

○: Little scattering of the powder is observed, but a fly amount is extremely small and the flying powder can be recovered using a dust arrestor. Therefore, a working atmosphere does not get worse.

Δ: Flying of the powder is observed and the working atmosphere is likely to get worse.

×: Flying of the powder is serious and the working atmosphere gets worse.

Handling workability:

The adhesion between sheets at the time of peeling of sheets after vulcanization, the degree of sticking between cross sections of the thread rubber after cutting, the state of stretching of the thread rubber at the time of winding the thread rubber around the liquid center with stretching and the extent of dame of the thread rubber are examined and evaluated according to the following criteria.

Evaluation criteria:

⊙: Adhesion between sheets, sticking between thread rubbers and damage of the thread rubber are not observed. The state of stretching is good and the handling workability is extremely excellent.

○: It is slightly inferior in comparison with the above criterion ⊙, but the handling workability is good.

Δ: The handling workability is inferior in comparison with the above criterion ○, but it is not inferior and is normal.

×: Adhesion between sheets, sticking between thread rubbers and damage of the thread rubber are arisen, and the handling workability is inferior.

Ball compression:

It is measured according to PGA system.

Resilience coefficient:

It is measured at an initial velocity (of projectile) of 45 m/second using an air gun of which type is the same as that of an air gun for measuring an initial velocity at R & A. The larger the value, the better the resilience coefficient of the golf ball.

Hammering durability:

A golf ball is struck against a metal plate at a speed of 45 m/second using an air gun, and the number of times until the cover is peeled off from the thread wound core. The larger the value, the better the hammering properties.

Cut resistance:

A blade having a predetermined sharp edge is allowed to collide at the golf ball. The degree of damage is indicated as an index in case of the value of the golf ball of Comparative Example 1 being 100. The larger the value, the better the cut resistance.

TABLE 1

| | Example No. | | |
|---|---|---|---|
| | 1 | 2 | 3 |
| Inorganic powder: | | | |
| Talc *1 | 65 | 50 | 35 |
| Magnesium carbonate *2 | 35 | 50 | 65 |
| Characteristics of thread rubber: | | | |
| Flying properties of inorganic powder | ○ | ⊙ | ⊙ |
| Handling workability | ⊙ | ⊙ | ○ |
| Ball physical properties: | | | |
| Ball compression | 90 | 90 | 90 |
| Resilience coefficient | 0.7700 | 0.7705 | 0.7708 |
| Hammering durability | 83 | 85 | 85 |
| Cut resistance | 115 | 120 | 125 |

*1 Talc manufactured by Maruo Calcium Co., Ltd., true specific gravity: 2.82
*2 Magnesium carbonate manufactured by Kamishima Kagaku Co., Ltd. (quality: two star), true specific gravity: 2.17 to 2.30

Comparative Examples 1 and 2

Only talc or magnesium carbonate which is the same as that used in Examples 1 to 3 was adhered on the surface of a thread rubber according to the same manner as that described in Examples 1 to 3, and the thread rubber was wound on a liquid center having a diameter of 28 mm to prepare a thread wound core having a diameter of 39 mm. Thereafter, according to the same manner as that described in Examples 1 to 3, the thread wound core was covered with a balata half shell and subjected to a press vulcanization, and then a paint was applied on the surface to prepare a thread wound golf ball having an outer diameter of 42.7 mm.

Regarding the above thread rubber, the flying properties of the inorganic powder and handling workability were examined according to the same manner as that described in Examples 1 to 3. Further, the ball compression, the resilience coefficient, the hammering durability and the cut resistance of the resulting golf ball were examined according to the same manner as that described in Examples 1 to 3. The results are also shown in Table 2.

TABLE 2

| | Comparative Example No. | |
|---|---|---|
| | 1 | 2 |
| Inorganic powder: | | |
| Talc | 100 | — |
| Magnesium carbonate | — | 100 |
| Characteristics of thread rubber: | | |
| Flying properties of inorganic powder | x | ⊙ |
| Handling workability | ⊙ | x |
| Ball physical properties: | | |
| Ball compression | 89 | 90 |
| Resilience coefficient | 0.7676 | 0.7676 |
| Hammering durability | 72 | 84 |
| Cut resistance | 100 | 127 |

As is apparent from the results shown in Tables 1 and 2, regarding the golf balls of Examples 1 to 3 of the present invention, little flying of the inorganic powder from the surface of the thread rubber was observed and the handling workability is good in comparison with the golf ball of Comparative Example 1 as a conventional example, wherein only talc was adhered on the surface of the thread rubber. Regarding ball physical properties, the resilience coefficient was large and both hammering durability and cut resistance were excellent. On the contrary, regarding the golf ball of Comparative Example 2 wherein only magnesium carbonate was adhered on the surface of the thread rubber, little flying of the inorganic powder from the surface of the thread rubber was observed, but the handling workability was inferior and it was not suitable for practical application.

The reason why the golf balls of Examples 1 to 3 of the present invention are superior to that of Comparative Example 1 is considered as follows. That is, since the thread rubber is wound around the liquid center in a state where it is uniformly stretched, the resilience properties are improved. In addition, the inorganic powder is uniformly adhered on the surface of the thread rubber so that an adhesion between the core and cover is improved in comparison with the case that only talc is used, thereby improving the hammering durability and cut resistance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A thread rubber for a thread wound golf ball, said thread rubber containing a coating which comprises an inorganic powder having excellent lubricity and an inorganic powder having a small intermolecular cohesive force and excellent adhesion, the weight ratio of the inorganic powder having excellent lubricity to the inorganic powder having a small intermolecular cohesive force is within the range of 85/15 to 30/70.

2. The thread rubber of claim 1, wherein the inorganic powder having excellent lubricity is a member selected from the group consisting of talc (hydrated magnesium silicate) and mica powder and mixtures thereof and the inorganic powder having a small intermolecular cohesive force and excellent adhesion is a member selected from the group consisting of magnesium carbonate and calcium carbonate and mixtures thereof.

3. The thread rubber of claim 1 wherein the weight ratio of the inorganic powder having excellent lubricity to the inorganic powder having a small intermolecular cohesive force is within the range of 80/20 to 35/65.

4. The thread rubber of claim 1 wherein the amount of the inorganic powders which adhere to the thread rubber is 5 to 15 parts by weight, based on 100 parts by weight of the thread rubber.

5. The thread rubber of claim 1 wherein the amount of the inorganic powders which adhere to the thread rubber is 6 to 10 parts by weight, based on 100 parts by weight of the thread rubber.

6. A thread wound gold ball in which the thread is provided with a coating which comprises an inorganic powder having excellent lubricity and an inorganic powder having a small intermolecular cohesive force and excellent adhesion, the weight ratio of the inorganic powder having excellent lubricity to the inorganic powder having a small intermolecular cohesive force is within the range of 85/15 to 30/70.

7. The thread wound golf ball of claim 6, wherein the inorganic powder having excellent lubricity is a member selected from the group consisting of talc (hydrated magnesium silicate) and mica powder and mixtures thereof and the inorganic powder having a small intermolecular cohesive force and excellent adhesion is a member selected from the group consisting of magnesium carbonate and calcium carbonate and mixtures thereof.

8. The thread wound golf ball of claim 6, wherein the weight ratio of the inorganic powder having excellent lubricity to the inorganic powder having a small intermolecular cohesive force is within the range of 80/20 to 35/65.

9. The thread wound golf ball of claim 6, wherein the amount of the inorganic powders which adhere to the thread rubber is 5 to 15 parts by weight, based on 100 parts by weight of the thread rubber.

10. The thread wound gold ball of claim 6, wherein the amount of the inorganic powders which adhere to the thread rubber is 6 to 10 parts by weight, based on 100 parts by weight of the thread rubber.

11. A coating composition which comprises an inorganic powder having excellent lubricity and an inorganic powder having a small intermolecular cohesive force and excellent adhesion, the weight ratio of the inorganic powder having excellent lubricity to the inorganic powder having a small intermolecular cohesive force is within the range of 85/15 to 30/70.

12. The coating composition of claim 11, wherein the inorganic powder having excellent lubricity is a member selected from the group consisting of talc (hydrated magnesium silicate) and mica powder and mixtures thereof and the inorganic powder having a small intermolecular cohesive force and excellent adhesion is a member selected from the group consisting of magnesium carbonate and calcium carbonate and mixtures thereof.

13. The thread wound golf ball of claim 11, wherein the weight ratio of the inorganic powder having excellent lubricity to the inorganic powder having a small intermolecular cohesive force is within the range of 80/20 to 35/65.

14. The coating composition of claim 11, wherein the amount of the inorganic powders which adhere to the thread rubber is 5 to 15 parts by weight, based on 100 parts by weight of the thread rubber.

15. The coating composition of claim 11, wherein the amount of the inorganic powders which adhere to the thread rubber is 6 to 10 parts by weight, based on 100 parts by weight of the thread rubber.

* * * * *